US012453417B2

(12) United States Patent
Alvarez et al.

(10) Patent No.: US 12,453,417 B2
(45) Date of Patent: Oct. 28, 2025

(54) FIXING UNIT, A MOVEABLE ASSEMBLY, A BASE UNIT AND A METHOD FOR RELEASING A MOVEABLE ASSEMBLY

(71) Applicant: Reichle & De-Massari AG, Wetzikon (CH)

(72) Inventors: Bryce Alvarez, Milpitas, CA (US); Evgeni Zhelyazkov, Sofia (BG)

(73) Assignee: REICHLE & DE-MASSARI AG, Wetzikon (CH)

( * ) Notice: Subject to any disclaimer, the term of this patent is extended or adjusted under 35 U.S.C. 154(b) by 105 days.

(21) Appl. No.: 18/085,434

(22) Filed: Dec. 20, 2022

(65) Prior Publication Data

US 2023/0189991 A1 Jun. 22, 2023

(30) Foreign Application Priority Data

Dec. 21, 2021 (EP) ..... 21216599

(51) Int. Cl.
*A47B 88/43* (2017.01)
*A47B 88/423* (2017.01)

(52) U.S. Cl.
CPC ..... *A47B 88/43* (2017.01); *A47B 2088/4235* (2017.01)

(58) Field of Classification Search
CPC ..... A47B 88/43; A47B 2210/0016; A47B 2088/4235; A47B 2088/4274; A47B 2088/4276
See application file for complete search history.

(56) References Cited

U.S. PATENT DOCUMENTS 6,412,891 B1 * 7/2002 Liang ..... A47B 88/487 312/334.44
2005/0162052 A1 * 7/2005 Chen ..... A47B 88/497 312/334.5
2007/0241651 A1 * 10/2007 Burgess ..... A47B 88/493 312/333
2021/0037667 A1 2/2021 Mang et al.

OTHER PUBLICATIONS

European Search Report for Application No. 222215100.3, mailed May 16, 2023, 12 pages.
Extended European Search Report on the Patentability of Application No. 21216599.7, Mailed Jun. 9, 2022, 12 pages.

* cited by examiner

*Primary Examiner* — Matthew W Ing

(74) *Attorney, Agent, or Firm* — Womble Bond Dickinson (US) LLP

(57) ABSTRACT

The invention is based on a fixing unit (20, 20*a*) for reversibly fixing a moveable unit (18, 18*a*). For the purpose of providing a fixing unit with improved characteristics regarding flexibility, construction and/or a fixation, it is proposed that the fixing unit (20, 20*a*) is moveable parallel to a move direction (28, 28*a*) of the moveable unit (18, 18*a*) into a release position in order to release the moveable unit (18, 18*a*) from a guiding rail (26, 26*a*).

19 Claims, 13 Drawing Sheets

Figure 1:
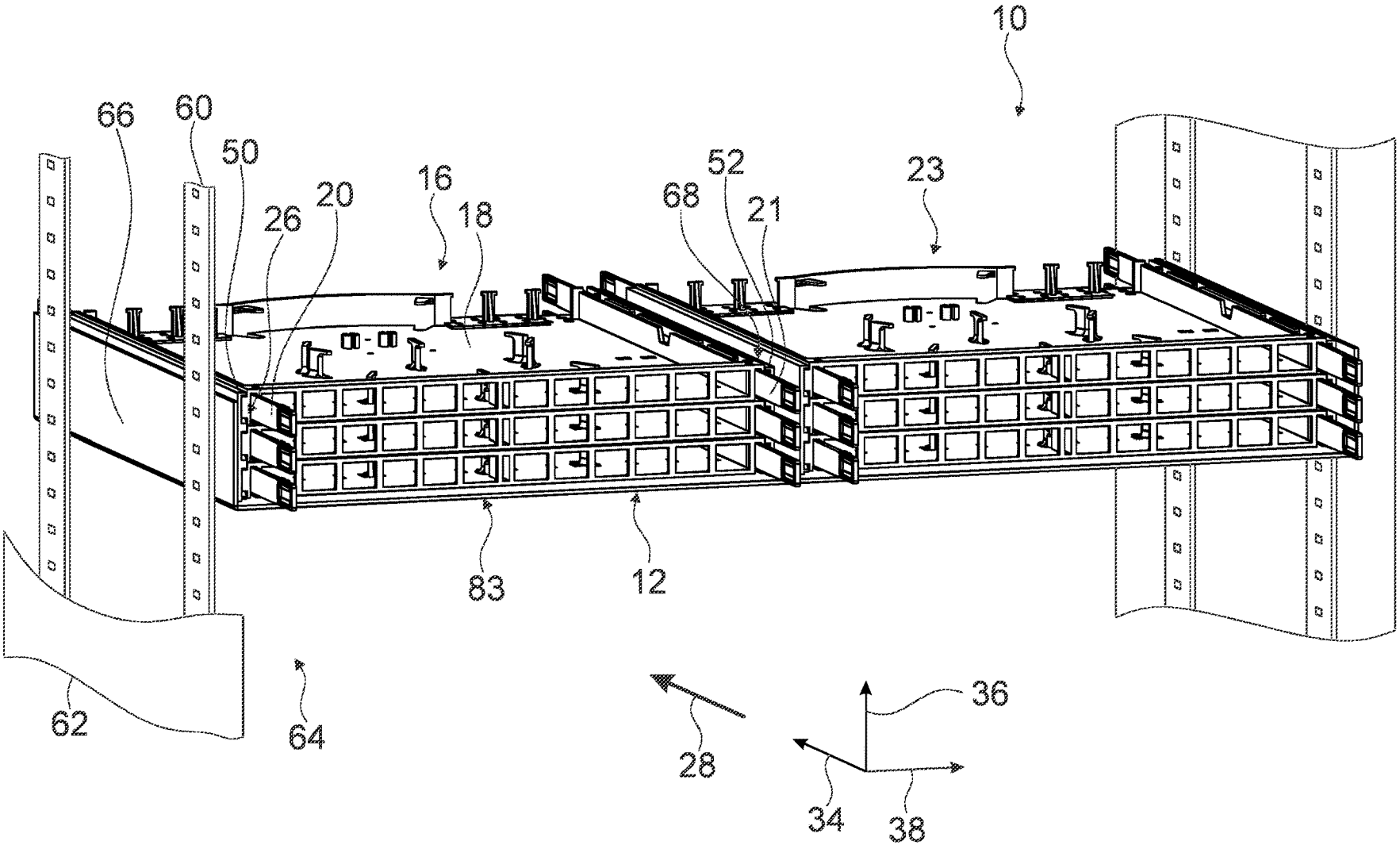

FIXING UNIT, A MOVEABLE ASSEMBLY, A BASE UNIT AND A METHOD FOR RELEASING A MOVEABLE ASSEMBLY

CROSS REFERENCE TO RELATED APPLICATIONS

This application is based on and incorporates herein by reference the European patent application EP 21216599.7, filed on Dec. 21, 2021, as well as the European follow-up application which is going to be filed in Dec. 21, 2022.

STATE OF THE ART

The invention relates to a fixing unit, a moveable assembly, a base unit and a method for releasing a moveable assembly.

From the state of the art drawer units, in particular panels, are known, which are moveable for an insertion into a cabinet. Moreover, snap-in connections or locking connections are also known to fix the drawer unit in cabinet.

The objective of the invention is, in particular, to provide a fixing unit with improved characteristics regarding flexibility, construction and/or a fixation. The objective is achieved according to the invention.

Advantages of the Invention

The invention is based on a fixing unit for fixing a moveable unit in at least one guiding rail.

It is proposed that the fixing unit is moveable parallel to a move direction of the moveable unit into a release position in order to release the moveable unit from the guiding rail.

By means of the invention an enhanced flexibility, construction and/or a fixation can be achieved. In particular a flexible mechanism for fixing a moveable unit can be achieved. Moreover, a compact embodiment can be achieved. This allows achieving a particularly flexible drawer system, in particular a cable management, without affecting other moveable units and/or further moveable units during movement of one moveable unit and/or fixing the moveable unit. Furthermore, a handling can be simplified as the fixing unit is intended for reversibly fixing the moveable unit in at least one guiding rail. In addition, a comfort, in particular a user comfort, can be increased. Additionally, in turn of a fixing unit which is moveable parallel to a move direction of the moveable unit, a simple and efficient fixation and/or releasing can be provided. Due to the fixing unit which is moveable parallel to the move direction, preferably at least two mechanism options for releasing the moveable unit can be provided for the user, in particular pushing and pulling the fixing unit.

At least the fixing unit can be part of a moveable assembly. Further, the moveable assembly can comprise the moveable unit, which is in particular embodied as a drawer unit. A drawer system is to be understood, in this context, as a modular construction system, which comprises a certain number of elements and units to provide a system with at least the moveable assembly. In particular, the drawer system comprises a base unit. Preferably, the base unit comprises at least the moveable assembly. In particular, the moveable unit is moveable relative to the base unit and can be inserted and pulled out of the base unit. Particularly preferably, the moveable unit is embodied as a drawer unit. For example, the drawer system can be part of a household system. The household system can comprise at least one item of household furniture and/or household appliance.

"Household system" is to be understood in this connection as a system for use in a household environment and/or for use with household objects, which in particular comprises at least one, in particular at least one partially electronic, item of household furniture, such as for example a food store and/or a spice rack, a cutlery cabinet and/or a tableware cabinet, and/or at least one household appliance, for example a household refrigeration appliance and/or a wine cooler and/or a cooking appliance and/or a washing appliance, like a washing machine and/or a dishwasher. The base unit can be at least one of this said items of household furniture and/or household appliance or at least a part of it. Further, the drawer system, in particular at least base unit and/or the moveable assembly, can be used for example in a pharmacy and/or in a workshop and/or in a doctor's office and/or in a medical practice and/or in a hospital. In particular, the drawer system, in particular the moveable assembly, can be used wherever a drawer system, in particular a moveable assembly, is needed.

In a preferred embodiment of this invention the drawer system is a cable management system. A "cable management system" is to be understood, in this context, as a modular construction system, which comprises a certain number of elements to build preferably in a modular way a unit or device which is configured to execute at least one function in at least one operational state. The cable management system is a system, preferably for use in a fiber optic network, in particular a data center. In particular, the cable management system is configured for terminating at least one cable and preferably a plurality of cables, in particular patch cables and/or for supporting an interconnection between a plurality of cables, in particular patch cables. Herein, the cable management system is preferably embodied as an optical distribution frame. Moreover, the cable management system may also comprise at least one cable, preferably optical waveguide cable. The drawer system can comprise at least one carrier unit, which may preferably be embodied as a rack and which is in particular configured for fastening the base unit at least indirectly and/or directly. Preferably, the base unit is embodied as a cable management unit. A "cable management unit" is to be understood, in this context, as a unit which is, in at least one operational state, configured for managing, in particular guiding, connecting, coupling, terminating and/or distributing, cables, in particular patch cables, in particular the plurality of cables, in particular the plurality of patch cables, preferably optical waveguide cables.

In particular, the base unit comprises at least one frame unit, in particular a chassis and/or an exterior housing, which can preferably be fastened to the carrier unit of the drawer system, in particular the cable management system, and which is configured to at least partly and preferably at least largely delimit at least one receiving space for receiving at least the moveable assembly and/or at least one further moveable assembly and preferably a plurality of moveable assemblies and/or further moveable assemblies, in particular at least two, preferably at least three and most preferably at least six moveable assemblies and/or further moveable assemblies. Preferably, the frame unit is an optical distribution frame unit.

Moreover, the base unit, in particular the cable management unit, could be embodied, for example, as an ETSI insert in particular with a standard width of 535 mm, as a 23-inch insert and/or as any other insert, in particular for connecting to an, in particular standard, ETSI rack, 23-inch rack and/or any other rack. However, the base unit is advantageously embodied as a 19-inch insert, in particular for connecting to an, in particular standard, 19-inch rack. Furthermore, the base unit is advantageously configured to support at least 144 fiber connections, in particular at least 144 LC simplex port connections whereby each two LC simplex port connections can be used as one LC double port connection, per height unit. Preferably, a port density of the base unit is at least 10 port connections, in particular, at least 50 port connections, advantageously at least 90 port connections, preferably at least 100 port connections, particularly preferably at least 144 port connections or at least 150 port connections per one height unit.

Preferably the frame unit is configured for receiving up to six moveable assemblies and/or further moveable assemblies wherein each of the moveable assemblies and/or further moveable assemblies received in the frame unit is preferably individually moveable, in particular with respect to any other moveable assemblies and/or further moveable assemblies and in particular with respect to the frame unit. Moreover, a "moveable assembly" is to be understood as an, in particular movably mounted, unit which is located in a storage position in particular in the receiving space and which is preferably configured for providing and/or supporting a connection functionality and/or a connection capability. In particular, the moveable assembly is embodied as a drawer assembly. Preferably, the moveable assembly and/or the further moveable assembly is configured for guiding, connecting, coupling, terminating and/or distributing at least one cable. Advantageously, the moveable assembly and/or the further moveable assembly extend at least largely over a half width of the base unit. In particular in the storage position the moveable assembly and/or further moveable assembly are arranged at least substantially in a same plane in a side by side position. In addition, the moveable assembly and/or the further moveable assembly could in particular have a height between 10% and 80%, preferably between 15% and 60% and particularly preferably between 20% and 40%, of a height of the base unit. However, preferably the moveable assembly and/or the further moveable assembly has a height of 33% of a height of the base unit. In addition, the moveable assemblies and/or the further moveable assemblies are preferably located in particular in two columns adjacent to each other and in three rows particularly preferably one above the other. The moveable assembly and/or the further moveable assembly has/have in particular each a modular structure. By the expression "having a modular structure" is herein to be understood, in particular, that the moveable assembly and/or the further moveable assembly itself and/or at least one structural component of the moveable assembly and/or the further moveable assembly has a modular structure and/or is implemented in such a way that it can be assembled modularly, for example like in a construction kit. In particular, herein at least one structural component of the moveable assembly and/or the further moveable assembly can be replaced by at least one further structural component.

Particularly preferably, at least the moveable assembly and at least the further moveable assembly, in particular the plurality of moveable assemblies and/or further moveable assemblies, are releasable from, connectable to and/or replaceable by each other individually and which can be at least largely embodied at least substantially identical to each other. Advantageously, the moveable assembly and/or the further moveable assembly are herein extendable and/or reducible in any required way.

The base unit can comprise at least one guiding unit. The guiding unit can be a part of the frame unit. Advantageously, the guiding rail is part of the guiding unit. The guiding unit can comprise at least two guiding rails, in particular a plurality of guiding rails. However, preferably the guiding unit comprises at least three guiding rails. In particular, the guiding unit has as many guiding rails as moveable assemblies can be arranged about one another inside the frame unit. Preferably the guiding unit is configured for receiving at least the moveable assembly and/or at least the further moveable assembly, wherein each of the moveable assemblies received in the guiding unit is preferably individually moveable parallel to an insertion direction of the moveable assembly along at least the guiding rail, in particular with respect to any other moveable assembly and in particular with respect to the guiding unit. Preferably, the move direction of the moveable unit is parallel to the insert direction. In particular, the move direction can be formulated as an insert direction of the moveable unit.

Particularly preferably, the cable management has at least one further guiding unit, which is constructed identical to the guiding unit. In particular, the guiding unit and the further guiding unit delimit the receiving space for the moveable assembly and/or at least the further moveable assembly. In particular, in the storage position the moveable assembly and/or the at least further moveable assembly is/are arranged between the guiding unit and the further guiding unit. The further guiding unit can have at least a further guiding rail. In the storage position, the moveable assembly can be arranged in the guiding rail and the further guiding rail. In particular, the moveable assembly is moveable parallel to the insertion direction along the guiding rail and the further guiding rail.

By the expression that the fixing unit is moveable "parallel to the move direction, in particular to the insertion direction" is herein to be understood, that the fixing unit is moveable in the direction of move, in particular insertion, and against the direction of move, in particular insertion. The insert direction is a direction in which the moveable assembly, in particular the moveable unit and/or the fixing unit, is inserted into at least the guiding rail, in particular into at least the guiding unit, preferably into the frame unit. Furthermore, by a "storage position" is to be understood, in particular, an in particular mechanically defined position, preferably with respect to the frame unit, of the moveable assembly and/or the further moveable assembly, in which a normal operation takes place and/or in which a processing, e.g. a maintenance, a new cabling, a patching and/or a splicing, is limited to a large extent. In particular, in the storage position the moveable assembly and/or the further moveable assembly is at least largely and preferably completely located and/or inserted in the receiving space of the base unit. In particular, in the storage position the moveable assembly is fixed and/or locked in at least the guiding rail. Advantageously, if the moveable assembly is in the storage position, the fixing unit is in a rest position. Preferably, the rest position, is a position, in which at least the moveable unit is fixed in at least the guiding rail.

The fixing unit is used for a reversibly fixing the moveable unit in the guiding rail. The moveable assembly can comprise at least a further fixing unit for reversibly fixing the moveable unit in at least the further guiding rail. In particular, instead of the rest position, in the release position the moveable unit is unfixed in the guiding unit. Particularly preferably, in the release position the moveable unit is only partly located and/or inserted in the receiving space.

In this context, "configured" is to mean specifically programmed, designed and/or equipped. By an object being configured for a certain function, it is to be understood that the object fulfills and/or implements this certain function in at least one application state and/or operating state An extension of the fixing unit can be smaller than an extension of the moveable unit. For the purpose of improving a comfort, in particular a handling for a user, and/or a construction, it is proposed that the extension of the fixing unit is greater than the extension of the moveable unit when viewed in depth direction. In particular, the extension of the fixing unit is by at least 5%, advantageously by at least 10%, preferably by at least 20%, particularly preferentially by at least 30% and especially advantageously of maximally 60% greater than the extension of the moveable unit. In particular, the extension of the moveable unit and/or the fixing unit is a longitudinal extension. In this case. a "longitudinal extension" of an object is to be understood as an extension of the object in a longitudinal extension direction of the object. Herein, the "longitudinal direction" of the object is a direction which is parallel to a longest edge and/or side of a smallest, in particular imaginary, cuboid which just encloses the object.

Further, it is proposed that the fixing unit has at least one operating element, which can be pulled or pushed parallel to the move direction, in particular the insertion direction, to release the moveable unit from the guiding rail. In this way, a flexibility, construction and/or a fixation can be further improved. Moreover, due to an operating element, which can be pulled or pushed, a comfort, in particular a handling for a user, can be optimized. This in turn can provide a simple and efficient releasing of the moveable unit from the guiding rail.

The operating element can be designed as a front handle. Preferably, the operating element extends beyond the moveable unit when viewed in depth direction. By pushing or pulling the operating element, the moveable unit can be moveable from the storage position into the release position. The expressions "above", "under", "front", "rear", "side", "left", "right", "top", "bottom" are to be understood with respect to an orientation of the base unit and/or the moveable assembly, in particular the moveable unit and/or the fixing unit, in the storage position.

Advantageously, the fixing unit has at least one further operating element, which is arranged relative to the operating element on an opposite side of the moveable unit. Thereby, an improved flexibility and/or comfort may be achieved, wherein a fixing unit in particular be individually usable and/or adapted to different needs of users. Due to two operating elements on different sides of a moveable unit, a flexibility of the user to release the moveable unit from the guiding rail can be improved. In addition, preferably at least four mechanism options for releasing the moveable unit can be provided for the user, in particular pushing and pulling the fixing unit parallel to an insertion direction.

The further operating element can be pulled or pushed parallel to the insertion direction to release the moveable unit from the guiding rail. Advantageously, the further operating element is designed as a rear handle. By pushing or pulling the further operating element, the moveable unit can be moveable from the storage position into the release position. Particularly preferably, a mechanism for releasing the moveable unit from the guiding rail comprises at least four options; front pull, front push, rear pull and rear push. For example, the operating element and the further operating element could be simultaneously pushed or pulled. Preferably, it is sufficient that only one of the operating elements, in particular the operating element or the further operating element, has to be pushed or pulled to release the moveable unit from the guiding rail.

The operating element and the further operating element can be at least substantially identical objects. The phrasing "at least substantially identical objects" is to mean, in this context, objects which advantageously have the same structure but may at least partially differ in particular as regards their functionality and/or their arrangement on another object. However, preferably the at least substantially identical objects are identical aside from manufacturing tolerances and/or within the range of standardized tolerances.

In one embodiment of the invention, it is proposed that the operating element can only be pulled parallel to the move direction to release the moveable unit in a pull direction, wherein if the moveable unit is in a storage position and the operating element is pushed parallel to the move direction, the operating element is intended to block a movement of the moveable unit in a push direction. This can prevent a moveable unit from falling out/pulling back in an uncontrolled manner. Further, in this way a safety and user comfort can be increased. Moreover, a thin, small and compact design of a fixing unit can be provided.

The fixing unit can comprise at least one blocking element. The blocking element can be flexible for deforming by pushing and/or pulling the operating element and/or the further operating element. By pulling the operating element in the pull direction, the blocking element can be stretched and the moveable unit can be released from the guiding rail. In particular, by pulling the operating element in the pull direction, the moveable unit can be released from the storage position. Preferably, by pulling the operating element parallel to the move direction, the moveable unit can be transferred from the storage position into a service position. In particular, in the service position the moveable assembly is at least partially arranged between the guiding unit and the further guiding unit. In the service position the moveable unit can be at least partially inserted in the guiding rail and at least partially protrude from the guiding rail, in particular be pulled out of the guiding rail. If the moveable unit is in the service position, a comfortable access to the moveable unit can be provided while minimizing physical disturbance of the surrounding cables. Further, an easy and comfortable handling of cables can be achieved, wherein cables, in particular patch cables, in particular the plurality of cables, can be pulled out or pushed in the moveable unit while the moveable unit is in the service position.

Advantageously, the moveable unit is locked in the service position, in particular an uncontrolled movement of the moveable unit is blocked. For transferring the moveable unit from the service position into the storage position, the operating element can be pushed in the push direction, in particular parallel to the move direction. By pushing the operating element, the moveable unit can slide along at least the guiding rail and can be transferred from the service position to the storage position. When the moveable unit is in the storage position, the moveable unit can be transferred in the service position by pulling the operating element in the pull direction. By pulling the operating element the moveable unit can slide along at least the guiding rail and can be transferred from the storage position to the service position.

By pushing the operating element in the push direction, the blocking element can be compressed for blocking the movement of the moveable unit, when the moveable unit is in the storage position. The blocking element can comprise a blocking nose. When the moveable unit is in the storage position and the operating element is pushed in the push direction, the blocking element can be deformed, preferably compressed, and the blocking nose can block the movement of the moveable unit in the push direction and thus prevents the moveable unit from slipping out and/or falling out from the guiding rail in the push direction. Preferably, the guiding rail comprises at least one notch. The notch can be arranged on a bottom side of the guiding rail. In particular, when the moveable assembly is at least partially arranged in the receiving space, in particular in the service and/or the storage position, the moveable unit is arranged between two guiding bars of the guiding unit, advantageously between an upper bar and a lower bar. Preferably, the upper bar comprises at least the notch. Further, the moveable unit can contact the lower bar, in particular can lay on the lower bar, when the moveable unit is at least partially arranged in the receiving space, in particular in the service and/or the storage position. When the moveable unit is in the storage position and the operating element is pushed in the push direction, the blocking element can be deformed, preferably compressed, and the blocking nose can contact the notch and can stick in the notch for blocking the movement of the moveable unit in the push direction.

In a preferred implementation of the invention, it is proposed that the fixing unit is bar-shaped. In this way, a compact, narrow and/or efficient construction and/or design can be provided. In particular, the fixing unit is plate-shaped. By the fact that an object is "bar-shaped/plate-shaped", in particular, it is to be understood that at least one smallest possible geometric cuboid, which just completely encloses the object, is bar-shaped/plate-shaped.

Advantageously, the longitudinal extension of the fixing unit is greater than a width extension of the fixing unit. In particular, the longitudinal extension of the fixing unit is by at least 20%, advantageously by at least 50%, preferably by at least 70%, particularly preferentially by at least 80% greater than the width extension of the fixing unit.

Further, it is proposed that a total width extension of the fixing unit is maximum 10 mm. In this way, a compact, narrow and/or efficient construction and/or design of at least a fixing unit, in particular a moveable assembly, can be provided. Advantageously, the fixing unit has a width extension, in particular a thickness, of maximally 8 mm, particularly advantageously of maximally 5 mm. A "width extension" of an object shall be understood in this context, as an extension of the object in a width direction of the object. The "width direction" of the object is a direction which is parallel to a second longest edge and/or side of a, in particular of said, smallest, in particular imaginary, cuboid which just encloses the object.

Additionally, it is proposed that the fixing unit comprises a resetting unit for transferring the fixing unit from the release position into a rest position. In this way, a fixation can be improved, wherein a moveable unit can be securely locked in a guiding rail. Moreover, a compact, narrow and/or efficient construction and/or design can be provided. The fixing unit can be arranged in a housing element of the moveable unit. Advantageously, the fixing unit and the housing element, which surrounds the fixing unit at least in sections, have a width extension, in particular a thickness, of maximally 15 mm, particularly advantageously of maximally 12 mm, preferably of maximally 10 mm and particularly preferably of maximally 8 mm. The resetting unit can cooperate with the housing element or with at least one element of the housing element for transferring the fixing unit from the release position into a rest position. In particular, the moveable unit is made in a one-piece embodiment.

For the purpose of improving a fixation and/or a flexibility, it is proposed that the resetting unit comprises at least one spring element, which is implemented for transferring the fixing unit from the release position into the rest position. Advantageously, at least the spring element is an elastic, in particular spring-elastic element. The spring element can be made at least partially or to a great part or completely from a mineral and/or a plastic and/or a metal, in particular spring steel or a stainless steel. In particular, the spring element cooperates with the housing unit. The housing unit can have at least one stopping element. Preferably, the spring element is arranged around the stopping element. The spring element can cooperate with the stopping element for transferring the fixing unit from the release position into the rest position. In particular, the spring element is flexible and/or moveable.

Preferably, the resetting unit comprises at least one further spring element, which is implemented for transferring the fixing unit from a further release position into the rest position. In this way, the fixation and/or a flexibility can be further improved. In addition, a simple and compact construction and/or design can be provided, which allows transferring a fixing unit from a further release position into a rest position. In particular, the further spring element cooperates with the housing unit. The housing unit can have at least one further stopping element. Preferably, the further spring element is arranged around the further stopping element. The further spring element can cooperate with the further stopping element for transferring the fixing unit from the further release position into the rest position. In particular, the further spring element is flexible and/or moveable. Advantageously, at least the further spring element is an elastic, in particular spring-elastic element. The further spring element can be made at least partially or to a great part or completely from a mineral and/or a plastic and/or a metal, in particular spring steel or a stainless steel. Possibly, the spring element and further spring element could be formed differently. Particularly preferably, the spring element and the further spring element are at least substantially identical objects.

Moreover, it is proposed that the fixing unit comprises a latch, which is arrangeable in a recess of the guiding rail for fixing the moveable unit to the guiding rail. In this way, a securely and preferably automatically locking/fixing of a moveable unit in a guiding rail can be provided, so that in general fixation can be further improved. In addition, a simple and compact construction and/or design can be provided and furthermore, a security and/or a comfort, in particular a user comfort, can be increased. Due to the arranged latch in the recess, the fixing unit can fix the moveable unit in the guiding rail. In particular, if the moveable assembly is in the storage position, the latch is arranged in the recess and fixed the moveable unit in the guiding rail. Preferably, is the moveable assembly in the storage position, the fixing unit is in the rest position. In the rest position and in the storage position, the moveable unit can be locked in at least the guiding rail. By insertion the moveable assembly, in particular at least the moveable unit, along the insertion direction into at least the guiding rail, the moveable assembly can be automatically locking with the guiding rail. For example, a user has to slide the moveable assembly both forwards or backwards until feeling a "click" and impossibility to move it further. In particular, this means the moveable assembly is automatically and securely locked in-place, and particularly preferably, the latch is arranged in the recess.

For the purpose of improving a flexibility and/or a simple and/or efficient and/or compact construction, it is proposed that the fixing unit comprises at least one flexible arm connected to the latch and to a body element of the fixing unit. The fixing unit can have a further flexible arm connected to the latch and to the body element. In particular, the further flexible arm is arranged relative to the flexible arm on an opposite side of the latch. Advantageously, the latch is held by the flexible arm and the further flexible arm. Preferably, the latch and the body element are not directly connected to each other. In particular, the latch and the body element are arranged contactless to each other in the rest position.

Further, it is proposed that the flexible arm is deformed when the fixing unit is in the release position. In this way, a simple and/or efficient way of releasing a fixing unit can be provided. Thereby an enhanced flexibility can be achieved. In particular, the flexible arm is compressed due to the front push and/or rear pull. Advantageously, due to the front push and/or rear pull the latch is moveable out of the recess. By deforming at least the flexible arm the latch can be moveable out of the recess. If the latch is lifted in the release position, the moveable unit can be moveable out of at least the guiding rail. In particular, the further flexible arm is compressed due to the front pull and/or rear push. Advantageously, due to the front pull and/or rear push the latch is moveable out of the recess. By deforming at least the further flexible arm the latch can be moveable out of the recess.

It is also proposed that the fixing unit is made in a one-piece embodiment. In this way, a construction can be further improved. By such a design/construction of a fixing unit, an efficiency, in terms of product and/or labor and/or assembly and/or manufacturing and/or cost efficiency, can be increased. By "made in a one-piece embodiment" is in particular to mean, connected at least by substance-to-substance bond, for example by a welding process, a gluing process, an injection-molding process, and/or another process that is deemed expedient by someone skilled in the art and/or advantageously formed in one piece, like for example by a production from a cast and/or by a production in a one-component or multi-component injection-molding procedure, and advantageously from a single blank.

Furthermore, it is proposed that, the fixing unit is symmetrical with respect to a symmetry plane, which is perpendicular to the insertion direction. Thereby a simple, efficient and/or and comfortable construction can be provided. Further, an improved flexibility and/or user comfort may be achieved, wherein a fixing unit may in particular be individually usable to different needs of users. Moreover, efficiency in a manufacturing process can be increased, as this symmetry is for the DFM (Design For Manufacturability) and can reduce costs. Due to the symmetrically fixing unit, preferably at least four mechanism options for releasing the moveable unit can be provided for the user, in particular pushing and pulling the fixing unit parallel to an insertion direction. The term that a plane is perpendicular to another plane is to be understood, that the plane and the other plane include a 90° angle and the angle has a maximum deviation of in particular less than 8°, advantageously less than 5° and especially advantageously less than 2°. In particular, the fixing unit is symmetrical with respect to the latch. The latch can be the center of a symmetry axis inside the symmetry plane.

In another aspect of the invention, which can in particular be considered in combination with as well as separately from other aspects of the invention, a method for releasing a moveable assembly, in particular the above-mentioned moveable assembly, from a guiding rail of a base unit, in particular the above-mentioned base unit, wherein a fixing unit is moved parallel to a move direction, in particular an insertion direction, of a moveable unit into a release position in order to release the moveable unit from a guiding rail of the base unit. By means of such a method an enhanced flexibility regarding a releasing and/or a fixation can be achieved. This allows achieving a particularly flexible moveable assembly, in particular without affecting other moveable assemblies and/or further moveable assemblies during movement of one moveable assembly and/or fixing the moveable assembly. Furthermore, a handling can be simplified. In addition, a comfort, in particular a user comfort, can be increased. Additionally, in turn of a fixing unit which is moveable parallel to an insertion direction of the moveable unit, a simple and efficient fixation and/or releasing can be provided. Due to the fixing unit which is moveable parallel to the insertion direction, preferably at least two mechanism options for releasing the moveable unit can be provided for the user, in particular pushing and pulling the fixing unit.

Herein the drawer system and/or the fixing unit and/or the moveable assembly and/or the base unit and/or the method is/are not to be limited to the application and implementation described above. In particular, for the purpose of fulfilling a functionality herein described, the drawer system and/or the fixing unit and/or the moveable assembly and/or the base unit and/or the method may comprise a number of respective elements, structural components and/or units and/or method steps that differs from the number mentioned herein. Furthermore, regarding the value ranges mentioned in this disclosure, values within the limits mentioned are to be understood to be also disclosed and to be used as applicable.

DRAWINGS

Further advantages may become apparent from the following description of the drawings. In the drawings two exemplary embodiments of the invention are shown. The drawings, the description and the claims contain a plurality of features in combination. The person having ordinary skill in the art will purposefully also consider the features separately and will find further expedient combinations.

If there is more than one specimen of a certain object, only one of these is given a reference numeral in the figures and in the description. The description of this specimen may be correspondingly transferred to the other specimens of the object.

Figure 2:
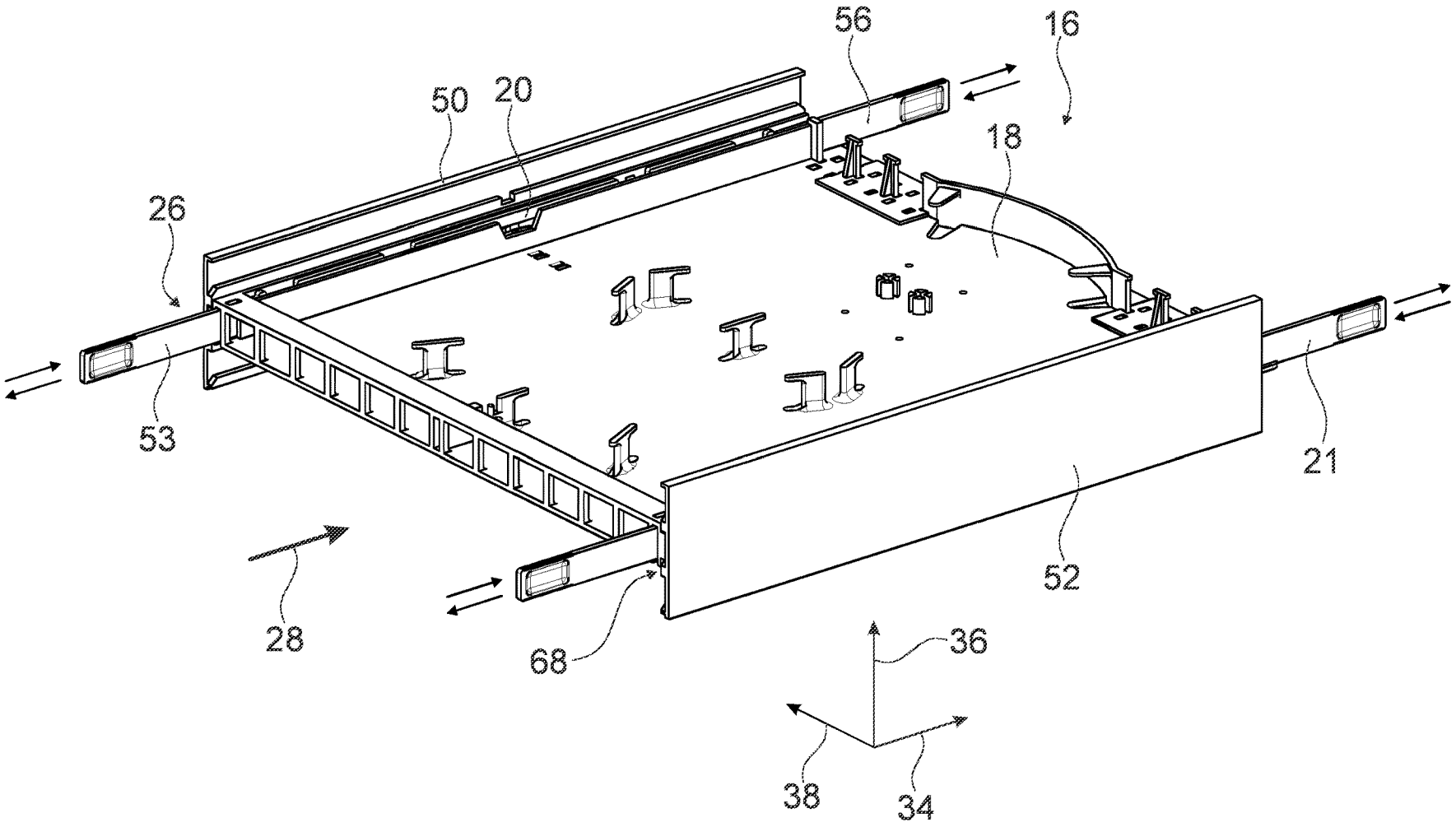
Figure 3:
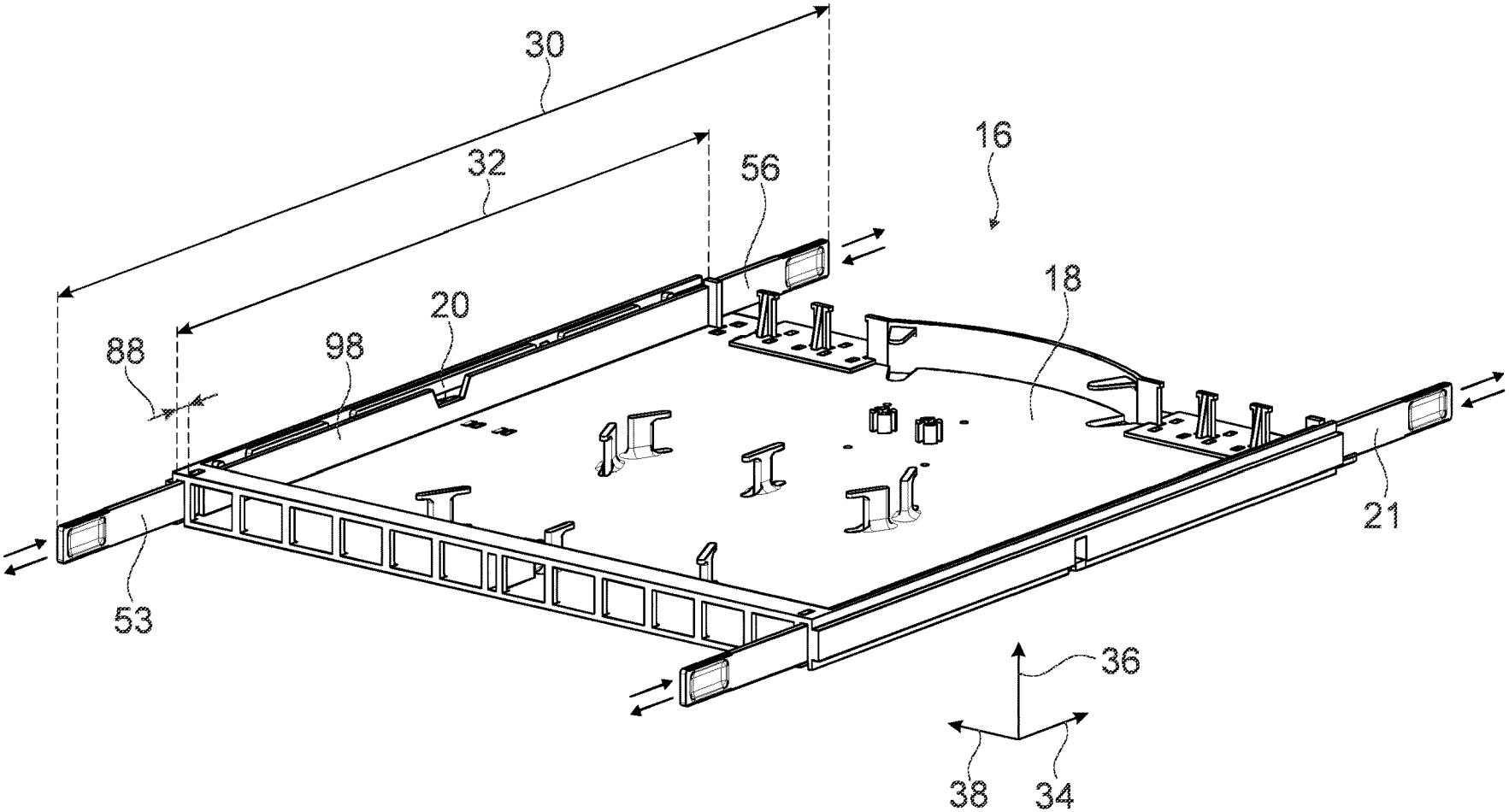
Figure 4:
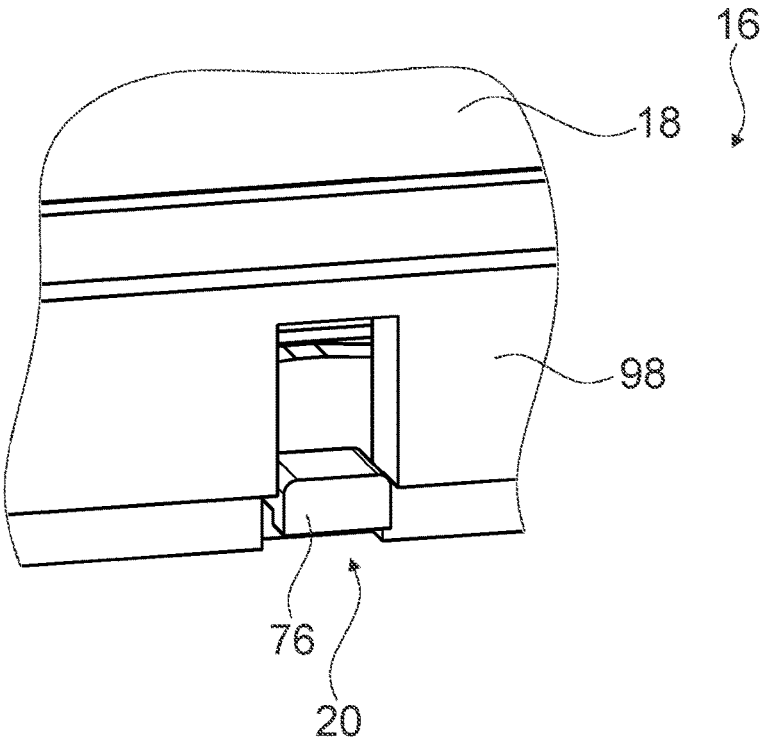
Figure 5:
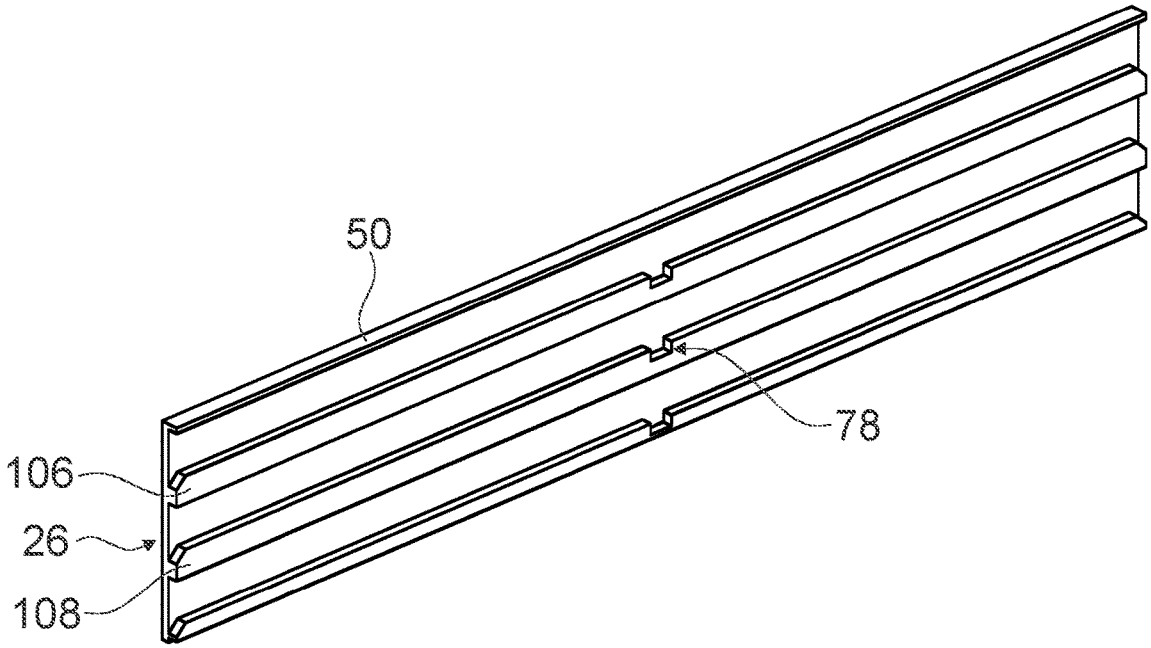
Figure 6:
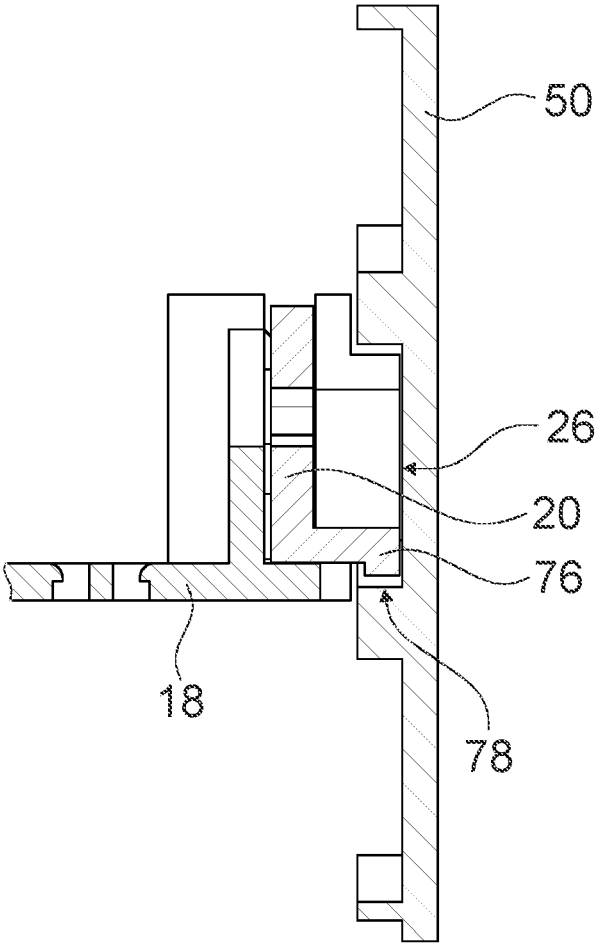
Figure 7:
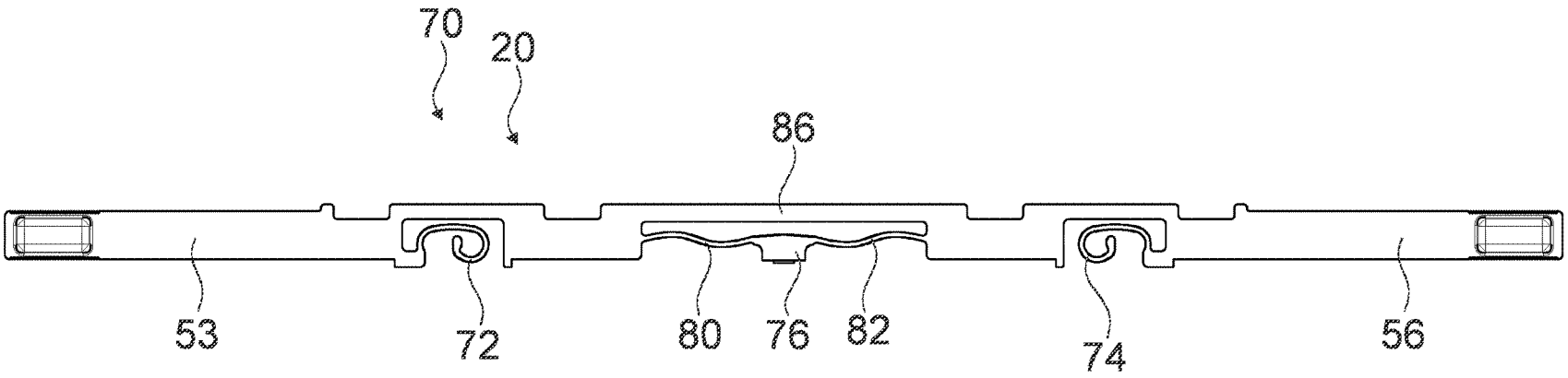
Figure 8:
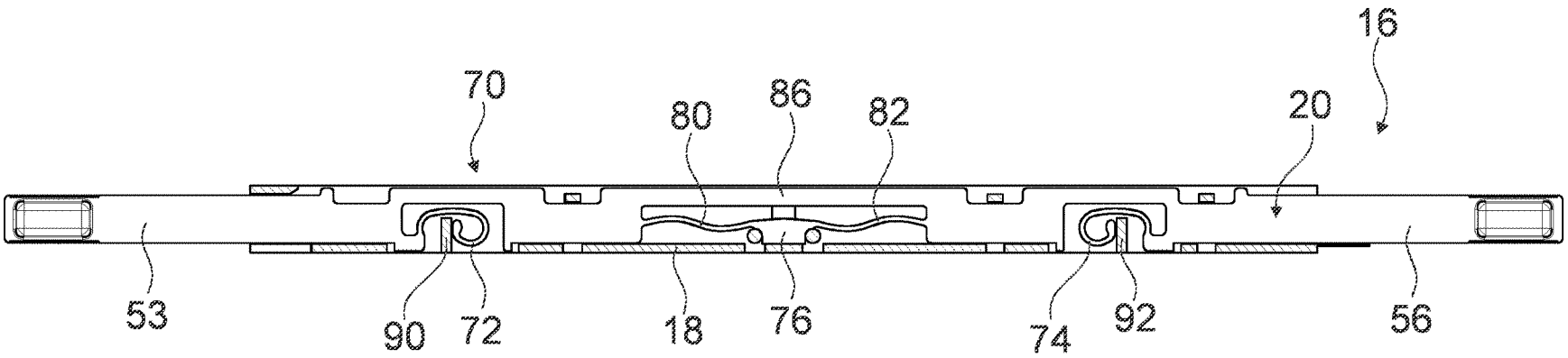
Figure 9:
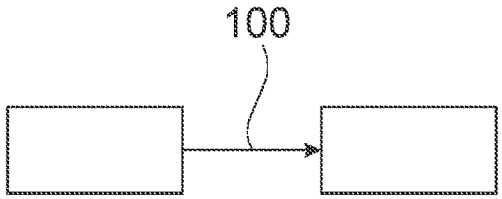
Figure 10:
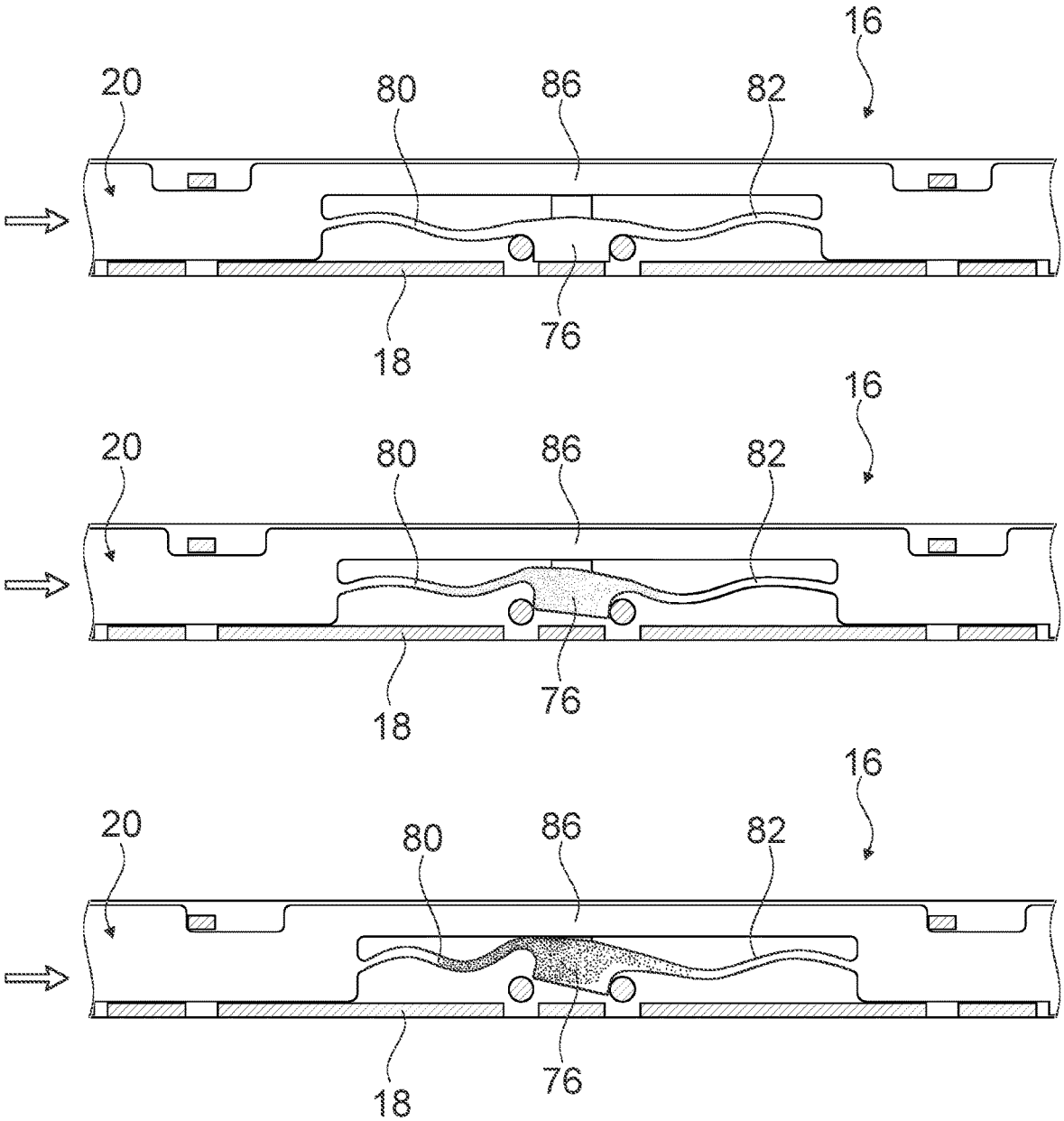
Figure 11:
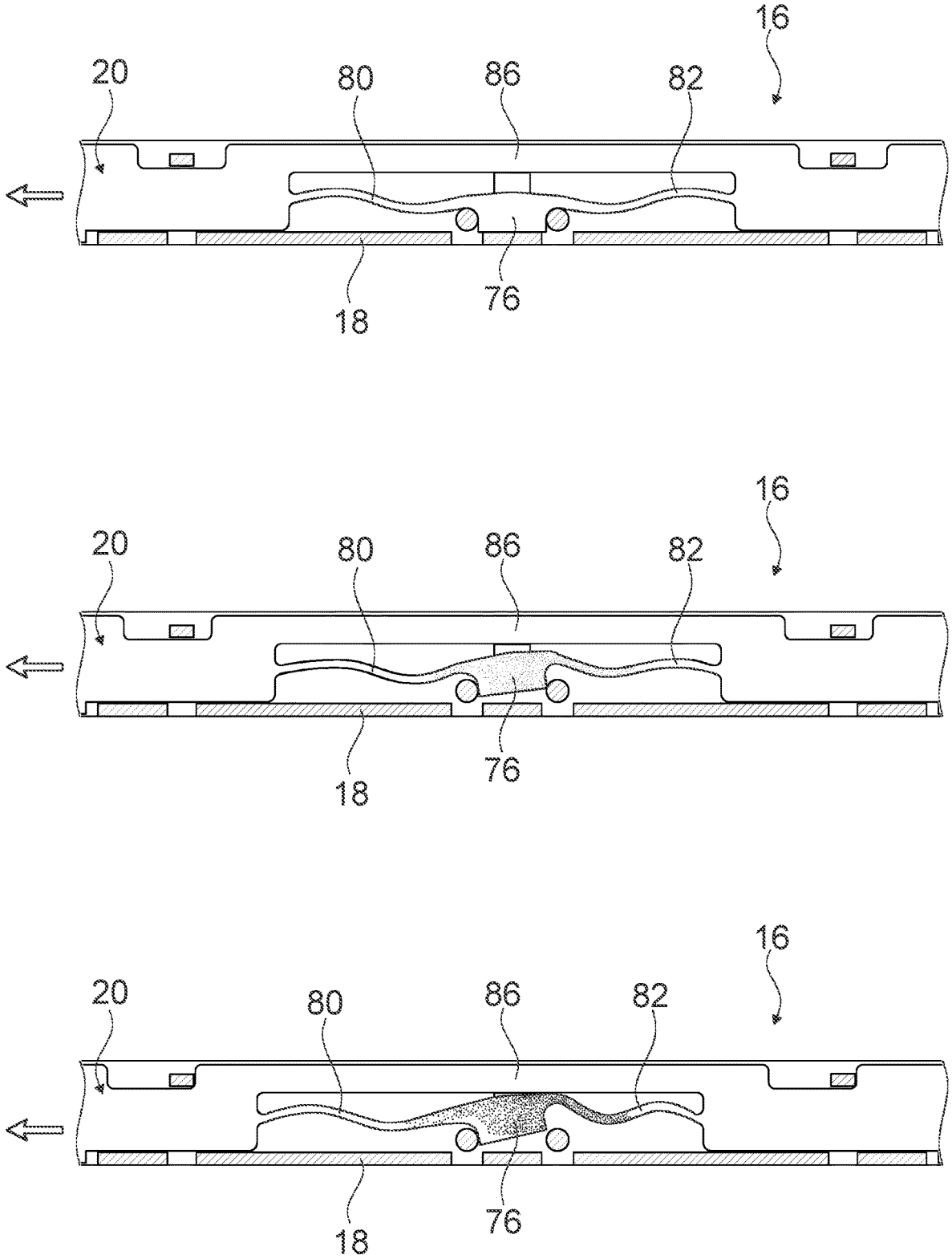
Figure 12:
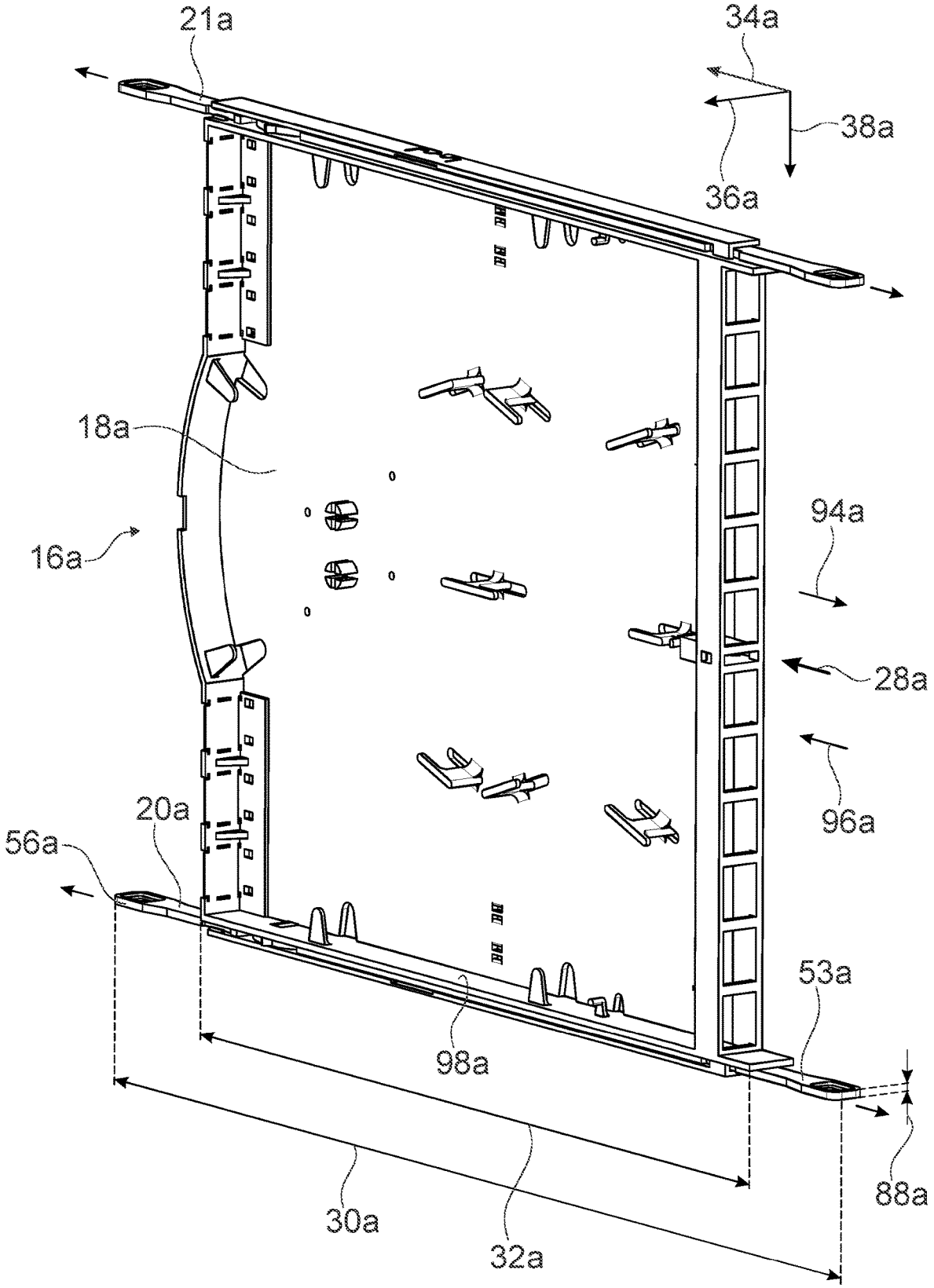
Figure 13:
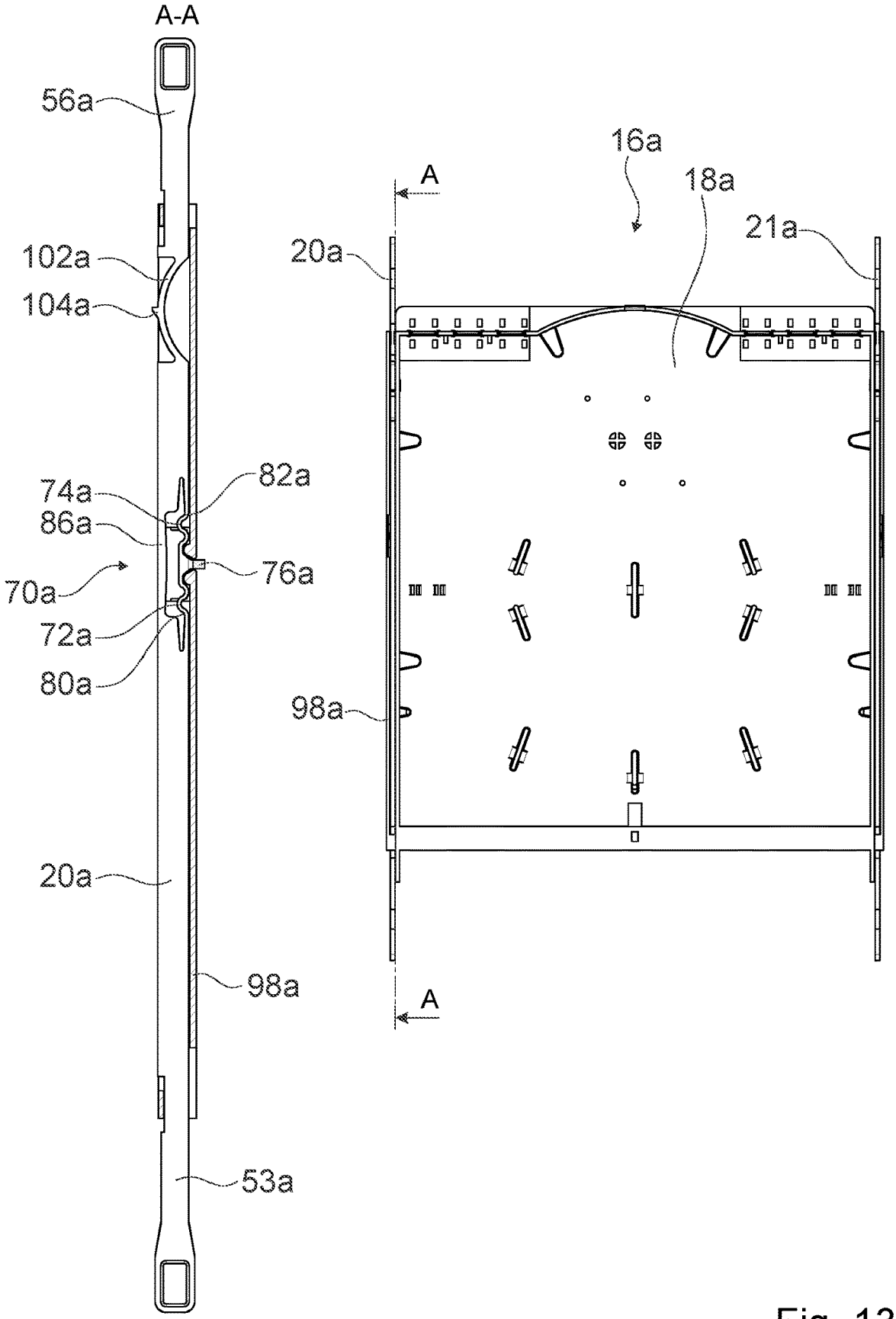
Figure 14:
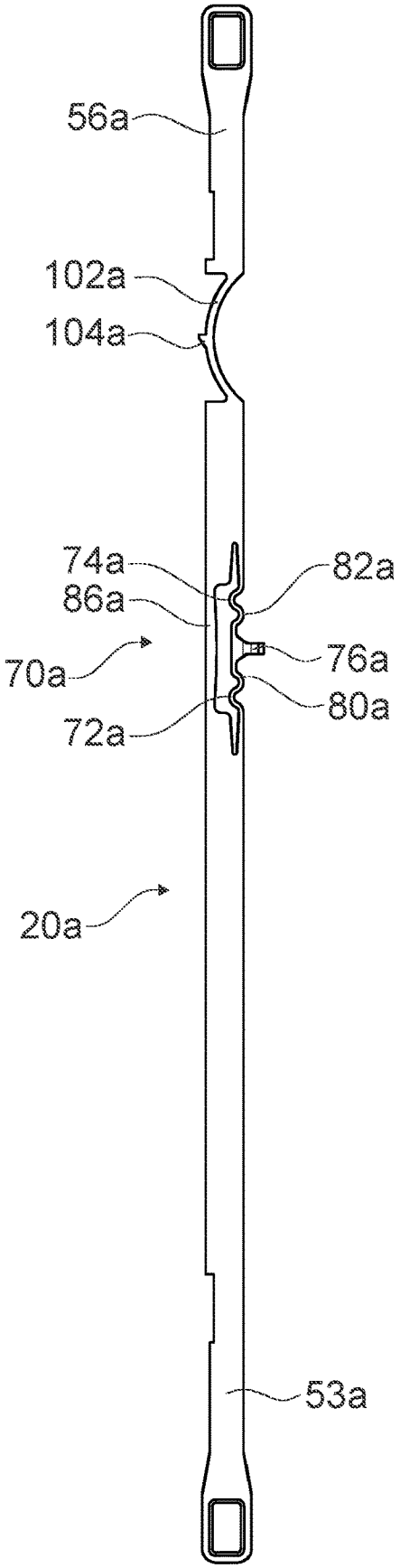
Figure 15:
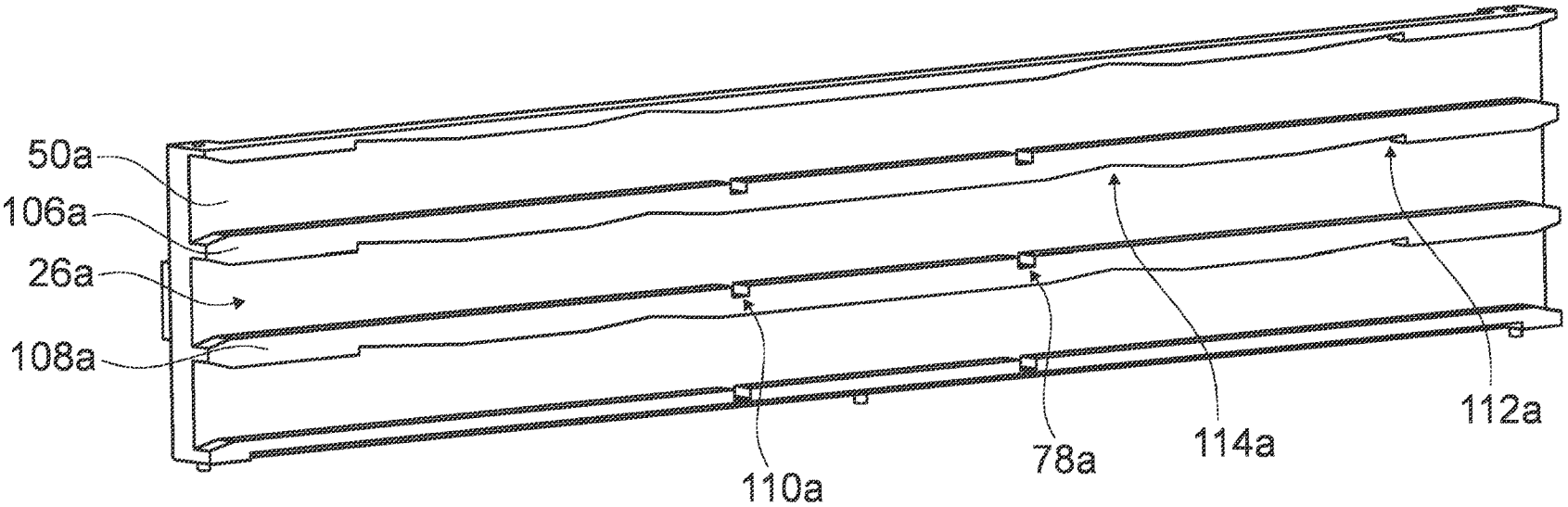

It is shown in:

FIG. 1 a schematic view of a drawer system having at least one base unit, which comprises at least one moveable assembly, FIG. 2 a perspective view of the base unit having a guiding unit with at least one guiding rail in which the moveable assembly is arranged, FIG. 3 a perspective top view of the moveable assembly comprising a fixing unit and a moveable unit, FIG. 4 a detail view of a latch of the fixing unit, FIG. 5 a detail view of the guiding unit, FIG. 6 a sectional view of the moveable assembly arranged in the guiding rail, FIG. 7 a detail view of the fixing unit, FIG. 8 a detail view of the assembled fixing unit on the moveable unit of the moveable assembly, FIG. 9 a diagram of a method for releasing the moveable assembly from the guiding rail, FIG. 10 a movement of the latch to release the moveable unit from the guiding rail when pushed an operating element of the fixing unit, FIG. 11 a movement of the latch to release the moveable unit from the guiding rail when pulled the operating element, FIG. 12 a perspective top view of a moveable assembly comprising at least one fixing unit and a moveable unit in a further embodiment of the invention, FIG. 13 a sliced view of the fixing unit arranged in the moveable unit according to FIG. 12, FIG. 14 a detailed view of the fixing unit according to FIGS. 12 and 13 and FIG. 15 a detailed view of a guiding unit comprising at least one guiding rail for receiving the moveable assembly according to FIGS. 12 to 14.

DESCRIPTION OF THE EXEMPLARY EMBODIMENTS

The following figures are schematic and not true-to-scale representations.

FIG. 1 schematically shows a drawer system 10 which is embodiment in this present case as a cable management system. Alterative and/or additional the drawer system 10 can be part of a household system, wherein the household system can comprise at least one item of household furniture and/or household appliance. Moreover, the drawer system 10 can be used for example in a pharmacy and/or in a workshop and/or in a doctor's office and/or in a medical practice and/or in a hospital. The drawer system 10 can be used wherever a drawer system is needed. In this present case, the description of the invention is carried out on the basis of a drawer system 10 embodied as the said cable management system (cf. FIG. 1).

The drawer system 10 is implemented as a network cabinet 62 with a rack 60. The drawer system 10 is configured for managing cables, which can be embodied as optical waveguide cables. However, it is also conceivable to use cables that differ from optical waveguide cables, e.g. electric cables.

The drawer system 10 comprises at least one base unit 12. In this present case the base unit 12 is embodied as a cable management unit. In the present case for the sake of clarity, only one base unit 12 is shown, but the drawer system 10 can also comprise a plurality of base units 12. If the drawer system 10 comprises the plurality of base units 12, the base units 12 can be located one above the other and can be at least substantially identical to each other. Moreover, the base units 12 can be releasable from, connectable to and/or replaceable with each other individually. The following description will be restricted to one of the base units 12, wherein, due to the at least substantially identical construction of the base units 12, the following description may also apply to possible other base units 12.

The base unit 12 is in the present case embodied as a 19-inch insert. The base unit 12 is intended to be used in a carrier unit 64 of the drawer system 10, in the present case in the rack 60. Herein, the base unit 12 is installed horizontally. The base unit 12 has a height of one height unit (U). The base unit 12 comprises a fiber connection density of at least 144 connections per height unit (U), wherein other values of connections per height unit are possible, such as at least 10 port connections, at least 50 port connections, at least 90 port connections or at least 150 port connections.

Furthermore, FIG. 1 shows that the base unit 12 comprises at least one moveable assembly 16. In this present case, the moveable assembly 16 is embodied as a drawer unit for insertion into the base unit 12. The base unit 12 can also comprise at least one further moveable assembly 23, wherein the base unit 12 can have a plurality of moveable assemblies 16, 23, in particular a plurality of moveable assemblies 16 and/or further moveable assemblies 23. In the present case, the base unit 12 comprises six moveable assemblies 16, 23 in total, wherein for the sake of clarity in FIG. 1 only one moveable assembly 16 and one further moveable assembly 23 comprise a reference numeral. The moveable assembly 16 and the further moveable assembly 23 are located adjacent to each other. The moveable assembly 16 and the further moveable assembly 23 are at least substantially identical to each other. Moreover, the moveable assembly 16 and the further moveable assembly 23 are individually releasable, connectable to and/or replaceable. The following description will be restricted only to the moveable assembly 16, wherein, due to the at least substantially identical construction of the moveable assemblies 16, 23, the following description may also apply to possible other moveable assemblies.

In a storage position at least the moveable assembly 16 is arranged in a receiving space 83 of the base unit 12. The base unit 12 comprises a frame unit 66 (cf. FIG. 1). The frame unit 66 is embodied as a chassis. The frame unit 66 forms an outer housing of the base unit 12. The frame unit 66 is in the present case made of metal, in particular metal sheets. Alternatively, the frame unit 66 may be made at least partly of a plastic material.

The base unit 12 has six receiving spaces 83 (cf. FIG. 1). The six receiving spaces 83 are arranged in two columns besides each other. The frame unit 66 defines and/or delimits the receiving spaces 83. The receiving space 83 is configured for receiving one moveable assembly 16 or one further moveable assembly 23. The receiving spaces 83 have the same dimensions. The moveable assembly 16 fits into the receiving space 83. The further moveable unit 18 fits also into the receiving space 83. The frame unit 66 is configured for receiving up to three moveable assemblies 16 and up to three further drawing units 23. The moveable assemblies 16 and/or the further moveable assemblies 23 received in the frame unit 66 are positioned in a storage position. The moveable assemblies 16 and/or the further moveable assemblies 18 received in the frame unit 66 are positioned over and/or besides each other.

In the present case three moveable assemblies 16 are placed one above each other in a stack (cf. FIG. 1). Further, three further moveable assemblies 23 are placed one above each other in a stack. As shown in FIG. 1, all moveable assemblies 16, 23 are in the storage position.

The frame unit 66 comprises at least one guiding unit 50. Further, the frame unit 66 has at least one further guiding unit 52. In the present case, the guiding unit 50 and the further guiding unit 52 defines and/or delimits the receiving spaces 83. The frame unit 66 can comprise a plurality of guiding units 50, 52, at least four guiding units 50, 52 in total. The base unit 12 is symmetrical. Therefore, the following description will be restricted to the guiding unit 50 and the further guiding unit 52.

In this case the guiding unit 50 and the further guiding unit 52 defines and/or delimits the receiving spaces 83 for at least the moveable assembly 16. As shown in FIGS. 1 and 2 at least the moveable assembly 16 is arranged between the guiding unit 50 and the further guiding unit 52. The base unit 12 comprises at least one guiding rail 26. The guiding rail 26 is a part of the guiding unit 50. In the present case, the guiding unit 50 comprises three guiding rails 26, wherein for the sake of clarity only one of the guiding rails 26 comprises a reference numeral. Further, the guiding unit 50 comprises at least two bars 106, 108. The guiding rail 26 comprises the two bars 106, 108, namely an upper bar 106 and a lower bar 108. When the moveable assembly 16 is at least partially arranged in the receiving space 83, the moveable assembly 16 is at least partially arranged between the upper bar 106 and the lower bar 108.

The base unit 12 comprises at least one further guiding rail 68. The guiding rail 68 is a part of the further guiding unit 52 (cf. FIGS. 1 and 2). In the present case, the further guiding unit 52 comprises three further guiding rails 68, wherein for the sake of clarity only one of the further guiding rails 68 comprises a reference numeral.

The moveable assembly 16 received in the frame unit 66, in particular in the guiding unit 50 and in the further guiding unit 52 is moveable from the storage position into a release position and vice versa. Each of the moveable assemblies 16 and/or the further moveable assemblies 23 is individually moveable with respect to any other moveable assemblies 16 and/or the further moveable assemblies 23. Each of the moveable assemblies 16 and/or the further moveable assemblies 23 is individually moveable with respect to the frame unit 66, from a storage position (cf. FIG. 1) into the release position and vice versa.

The moveable assembly 16 is moveable in a linear motion with respect to the frame unit 66. The moveable assembly 16 is moveable parallel to an insertion direction 28. This means, that the moveable assembly 16 is moveable in the insertion direction 28 and against the insertion direction 28. The moveable assembly 16 is moveable parallel to an insertion direction 28 along the guiding rail 26. The moveable assembly 16 is moveable parallel to an insertion direction 28 along the further guiding rail 68 (cf. FIG. 2). For a better understanding a coordination cross, in particular a height direction 36, a width direction 38 and a depth direction 34 are shown in FIGS. 1 to 3. The insertion direction 28 is parallel to the depth direction 34 (cf. FIGS. 1 and 2).

The moveable assembly 16 comprises at least one moveable unit 18 and at least one fixing unit 20 for reversibly fixing the moveable unit 18 in the guiding rail 26. The fixing unit 20 is moveable parallel to the insertion direction 28 of the moveable unit 18 into the release position in order to release the moveable unit 18 from the guiding rail 26 (cf. FIG. 2).

The moveable assembly 16 comprises at least one further fixing unit 21 for reversibly fixing the moveable unit 18 in the further guiding rail 68. The further fixing unit 21 is moveable parallel to the insertion direction 28 of the moveable unit 18 into the release position in order to release the moveable unit 18 from the further guiding rail 68 (cf. FIG. 2). The following description will be restricted to the fixing unit 20, wherein, due to the at least substantially identical construction of the fixing unit 20 and the further fixing unit 21, the following description may also apply to possible at least the further fixing unit 21. Further, it is conceivable that the fixing unit 20 and the further fixing unit 21 are connected by a link or handle joining of the moveable assembly 16. This would allow a movement of one of the fixing units 20, 21 to be transferred to the other fixing unit 20, 21 in each case.

As shown in FIG. 3, an extension 30 of the fixing unit 20 is greater than an extension 32 of the moveable unit 18 when viewed in depth direction 34. The fixing unit 20 has at least one operating element 53, which can be pulled or pushed parallel to the insertion direction 28 to release the moveable unit 18 from the guiding rail 26. The operating element 53 is designed as a front handle. The fixing unit 20 has at least one further operating element 56, which is arranged relative to the operating element 53 on an opposite side of the moveable unit 18. The further operating element 56 can be pulled or pushed parallel to the insertion direction 28 to release the moveable unit 18 from the guiding rail 26. The further operating element 56 is designed as a rear handle. In this case, the mechanism for releasing the moveable unit 18 from the guiding rail 26 comprises four options; front pull, front push, rear pull and rear push (cf. FIGS. 1 and 2).

As shown in FIG. 7, the fixing unit 20 is bar-shaped. The fixing unit 20 is made in a one-piece embodiment. The fixing unit 20 is arranged in a housing element 98 of the moveable unit 18 on a side of the moveable unit 18. Further, the fixing unit 20 including the housing element 98 has a thickness 88 of maximally 10 mm, advantageously of maximally 8 mm, particularly advantageously of maximally 5 mm. The fixing unit 20 is in the present case made at least partly of material plastic. Alternatively, the fixing unit 20 may be made at least partly of material metal.

The fixing unit 20 comprises a resetting unit 70 for transferring the fixing unit 20 from the release position into a rest position. FIGS. 7 and 8 show the rest position of the resetting unit 70. The resetting unit 70 comprises at least one spring element 72, which cooperates with the moveable unit 18 for transferring the fixing unit 20 from the release position into the rest position. Whereas FIG. 7 shows only the fixing unit 20, FIG. 8 shows the fixing unit 20 arranged in the housing element 98 of the moveable unit 18, wherein the housing unit 98 is sliced. The moveable unit 18 comprises a stopping element 90. In this case, the stopping element 90 is part of the housing element 98. The spring element 72 is arranged around the stopping element 90. The spring element 72 cooperates with the stopping element 90 for transferring the fixing unit 20 from the release position into the rest position.

The resetting unit 70 comprises at least one further spring element 74, which cooperates with the moveable unit 18 for transferring the fixing unit 20 from a further release position into the rest position. The moveable unit 18 comprises a further stopping element 92. In this case, the stopping element 92 is part of the housing element 98. The spring element 74 is arranged around the further stopping element 92. The further spring element 74 cooperates with the further stopping element 92 for transferring the fixing unit 20 from the further release position into the rest position.

The fixing unit 20 comprises a latch 76, which is arrangeable in a recess 78 of the guiding rail 26 for fixing the moveable unit 18 to the guiding rail 26 (cf. FIGS. 4 to 6). FIG. 6 shows the situation when the latch 76 is arranged in the recess 78 of the guiding rail 26, so that the moveable assembly 16 is in the storage position. When the moveable assembly 16 is in the storage position, the fixing unit 20 is in the rest position (cf. FIG. 6). In the rest position and in the storage position, the moveable unit 18 is locked in at least the guiding rail 26. By insertion of the moveable assembly 16 along the insertion direction 28 into at least the guiding rail 16, the moveable assembly 16 is automatically locking with the guiding rail 26.

A user has to slide the moveable assembly 16 both forwards or backwards until feeling a "click" and impossibility to move it further. This means the moveable assembly 16 is automatically and securely locked in-place. Moreover, this means that the latch 76 is arranged in the recess 78.

The fixing unit 20 comprises at least one flexible arm 80 connected to the latch 76 and to a body element 86 of the fixing unit 20 (cf. FIGS. 7 and 8). Furthermore, the fixing unit 20 comprises at least one further flexible arm 82 connected to the latch 76 and to the body element 86 of the fixing unit 20. The further flexible arm 82 is arranged relative to the flexible arm 80 on an opposite side of the latch 76. The fixing unit 20 is symmetrical with respect to a symmetry plane, which is perpendicular to the insertion direction 28. In this case, the fixing unit 20 is symmetrical with respect to the latch 76.

FIG. 9 shows a schematic diagram of a method for releasing the moveable assembly 16 from the guiding rail 26, wherein a fixing unit 20 is moved parallel to the insertion direction 28 of the moveable unit 18 into the release position in order to release the moveable unit 18 from the guiding rail 26 of the base unit 12. The method for releasing the moveable assembly 16 from the guiding rail 26 comprises a releasing step 100, by means of which the method is described in this case.

FIGS. 10 and 11 are intended to illustrate the method for releasing. The mechanism for releasing the moveable unit 18 from the guiding rail 26 comprises four options; front pull, front push, rear pull and rear push. For example, FIG. 10 shows the option of front push, in particular if the operating element 53 is pushed along the insert direction 28. Moreover, FIG. 11 shows the option of front pull, in particular if the operating element 53 is pulled against the insert direction 28 but parallel to the insertion direction 28.

The latch 76 and the body element 86 are arranged contactless to each other in the rest position (cf. first picture of FIGS. 10 and 11). The flexible arm 80 is deformed when the fixing unit 20 is in the release position. FIG. 10 shows that the flexible arm 80 is compressed due to the front push. This makes the latch 76 moveable out of the recess 78. In the last picture of FIG. 10, it is shown that the latch 76 is lifted, so that the moveable unit 18 can be moveable out of at least the guiding rail 26.

FIG. 11 shows the option of front pull to release the moveable assembly 16 from the guiding rail 26. In this case, the further flexible arm 82 is deformed when the fixing unit 20 is in the further release position. FIG. 11 shows that the further flexible arm 82 is compressed due to the front pull. This makes the latch 76 moveable out of the recess 78. In the last picture of FIG. 11, it is shown that the latch 76 is lifted, so that the moveable unit 18 can be moveable out of at least the guiding rail 26.

For a better understanding of working force to the flexible arm 80, the further flexible arm 82 and/or the latch 76 during deformation, FIGS. 10 and 11 shows different shaded areas which represent areas with different strong deformation forces. A greater force acts on areas with more dots/stronger shading.

Both described options of mechanism for releasing the moveable unit 18 from the guiding rail 26 can be transferred to the rear side of the fixing unit 20. The rear pull and the rear push have the same effect to a deforming of the flexible arm 80 and/or the further flexible arm 82.

FIGS. 12 to 15 show a further exemplary embodiment of the invention. The following description is substantially limited to the differences between the exemplary embodiments, wherein regarding structural elements, features and functions that remain the same the description of the other exemplary embodiment, in particular the exemplary embodiment of FIGS. 1 to 11, may be referred to. For distinguishing the exemplary embodiments, the letter "a" has been inserted into the reference signs in the exemplary embodiment of FIGS. 12 to 15. Regarding structural elements having the same denomination, namely regarding structural elements having the same reference signs, principally the drawing and/or the description of the other exemplary embodiment, in particular of the exemplary embodiment of FIGS. 1 to 11, may be referred to.

FIG. 12 shows a moveable assembly 16*a* which comprises at least one moveable unit 18*a* and at least one fixing unit 20*a* for reversibly fixing the moveable unit 18*a* in at least one guiding rail 26*a* of a guiding unit 50*a* (c.f. FIG. 15). The fixing unit 20*a* is moveable parallel to a move direction 28*a* of the moveable unit 18*a* into the release position in order to release the moveable unit 18*a* from the guiding rail 26*a*. While FIGS. 12 and 13 show the moveable assembly 16*a* comprising the fixing unit 20*a* arranged in a housing element 98*a* of the moveable unit 16*a* on a side of the moveable unit 18*a*, FIG. 14 shows a single and detailed view of the fixing unit 20*a*. Further FIG. 15 shows a detailed view of the guiding unit 50.

The embodiment "a" of the FIGS. 12 to 15 distinguishes from the embodiment of FIGS. 1 to 11 by the design and shape of the fixing unit 20*a* and by a design of the guiding unit 50*a*.

One difference between these two embodiments is that at least one operating element 53*a* of the fixing unit 20*a* can only be pulled parallel to the move direction 28*a* to release the moveable unit 18*a* in a pull direction 94*a*, wherein if the moveable unit 18*a* is in a storage position and the operating element 53*a* is pushed parallel to the move direction 28*a*, the operating element 53*a* is intended to block a movement of the moveable unit 18*a* in a push direction 96*a*.

In this embodiment, the fixing unit 20*a* comprises a blocking element 102*a*. The blocking element 102*a* is flexible for deforming by pushing and/or pulling the operating element 53*a* and/or a further operating element 56*a* of the fixing unit 20*a*. By pulling the operating element 53*a* in the pull direction 94*a*, the blocking element 102*a* is stretched and the moveable unit 18*a* can be released from the guiding rail 26*a*. Further, by pulling the operating element 53*a* in the pull direction 94*a*, the moveable unit 18*a* can be released from the storage position.

The moveable unit 18*a* is arrangeable in a service position. By pulling the operating element 53*a* parallel to the move direction 28*a*, the moveable unit 18*a* can be transferred from the storage position into the service position. In the service position the moveable assembly 16*a* is at least partially arranged between the guiding unit 50*a* and at least one further guiding unit (not shown). In the service position the moveable unit 18*a* is at least partially inserted in the guiding rail 26*a* and at least partially protrudes from the guiding rail 26*a*. If the moveable unit 16*a* is in the service position, a comfortable access to the moveable unit 16*a* can be provided while minimizing physical disturbance of surrounding cables. Further, an easy and comfortable handling of cables can be achieved, wherein cables, in particular patch cables, in particular the plurality of cables, can be pulled out or pushed in the moveable unit 16*a* while the moveable unit 16*a* is in the service position.

The moveable unit 16*a* is locked in the service position and an uncontrolled movement of the moveable unit 16*a* is blocked. For transferring the moveable unit 16*a* from the service position into the storage position, the operating element 53*a* can be pushed in the push direction 96*a*, in particular parallel to the move direction 28*a*. By pushing the operating element 53*a*, the moveable unit 16*a* slides along at least the guiding rail 26*a* and can be transferred from the service position to the storage position. When the moveable unit 16*a* is in the storage position, the moveable unit 16*a* can be transferred in the service position by pulling the operating element 53*a* in the pull direction 94*a*. By pulling the operating element 53*a* the moveable unit 18*a* slides along at least the guiding rail 26*a* and can be transferred from the storage position to the service position.

When the moveable unit 16*a* is in the storage position and the operating element 53*a* is pushed in the push direction

96*a*, the blocking element 102*a* is compressed for blocking the movement of the moveable unit 16*a*. The blocking element 102*a* comprises a blocking nose 104*a*. When the moveable unit 16*a* is in the storage position and the operating element 53*a* is pushed in the push direction 96*a*, the blocking element 102*a* is deformed, preferably compressed, and the blocking nose 104*a* blocks the movement of the moveable unit 18*a* in the push direction 96*a*. This can prevent the moveable unit 18*a* from slipping out and/or falling out from the guiding rail 26*a* in the push direction 96*a* in an uncontrolled manner.

FIG. 15 shows that the guiding rail 26*a* comprises at least one notch 112*a*. When the moveable assembly 16*a* is at least partially arranged in the service and/or the storage position, the moveable unit 18*a* is arranged between two guiding bars of the guiding unit 50*a*, advantageously between an upper bar 106*a* and a lower bar 108*a*. In this present case, the upper bar 106*a* comprises at least the notch 112*a*. Further, the moveable unit 18*a* contacts the lower bar 108*a*, in particular can lay on the lower bar 108*a*, when the moveable unit 16*a* is at least partially arranged in the receiving space 83*a*, namely in the service and/or the storage position. When the moveable unit 16*a* is in the storage position and the operating element 53*a* is pushed in the push direction 96*a*, the blocking element 102*a* is deforming, preferably compressing, and the blocking nose 104*a* is contacting the notch 112*a* and sticks in the notch 112*a* for blocking the movement of the moveable unit 16*a* in the push direction 96*a*.

The fixing unit 20*a* comprises a latch 76*a*, which is arrangeable in a recess 78*a* of the guiding rail 26*a* for fixing the moveable unit 18*a* to the guiding rail 26*a* in the storage position. The guiding rail 26*a* comprises a further recess 110*a*. In this present case, the further recess 110*a* defines the service position. The latch 76*a* of the fixing unit 20*a* is arrangeable in the further recess 110*a* for arranging the moveable unit 18*a* in the service position. Further, the guiding rail 26*a* comprises at least one relief element 114*a*. When the moveable unit 18*a* is arranged in the service position, namely the latch 76*a* is arranged in the further recess 110*a*, the relief element 114*a* is intended for relieving stress on the blocking element 102*a*. FIG. 15 shows that the guiding unit 50*a* is symmetrical with respect to a symmetry plane, which is perpendicular to the move direction 28*a*.

The fixing unit 20*a* comprises at least one flexible arm 80*a* connected to the latch 76*a* and to a body element 86*a* of the fixing unit 20*a* (cf. FIGS. 13 and 14). Furthermore, the fixing unit 20*a* comprises at least one further flexible arm 82*a* connected to the latch 76*a* and to the body element 86*a* of the fixing unit 20*a*. The further flexible arm 82*a* is arranged relative to the flexible arm 80*a* on an opposite side of the latch 76*a*. Further, the fixing unit 20*a* comprises a resetting unit 70*a* for transferring the fixing unit 20*a* from the release position into a rest position. FIGS. 13 and 14 show a rest position of the resetting unit 70*a*. The resetting unit 70*a* comprises at least one spring element 72*a*, which cooperates with the moveable unit 18*a* for transferring the fixing unit 20*a* from the release position into the rest position. In this embodiment according to FIGS. 12 to 14, the spring element 72*a* is part of the flexible arm 80*a*. The spring element 72*a* and the flexible arm 80*a* are made in a one-piece embodiment. The resetting unit 70*a* comprises at least one further spring element 74*a*, which cooperates with the moveable unit 18*a* for transferring the fixing unit 20*a* from a further release position into the rest position. The further spring element 74*a* is part of the further flexible arm 82*a*. The further spring element 74*a* and the further flexible arm 82*a* are made in a one-piece embodiment. Whereas FIG. 14 shows only the fixing unit 20*a*, FIG. 13 shows the fixing unit 20*a* arranged in the housing element 98*a* of the moveable unit 18*a*, wherein the housing element 98*a* is sliced.

REFERENCE NUMERALS

10 drawer system
12 base unit
16 moveable assembly
18 moveable unit
20 fixing unit
21 fixing unit
23 moveable unit
26 guiding rail
28 move direction
30 extension
32 extension
34 depth direction
36 height direction
38 width direction
50 guiding unit
52 guiding unit
53 operating element
56 operating element
60 rack
62 network cabinet
64 carrier unit
66 frame unit
68 guiding rail
70 resetting unit
72 spring element
74 spring element
76 latch
78 recess
80 flexible arm
82 flexible arm
83 receiving space
86 body element
88 thickness
90 stopping element
92 stopping element
94 pull direction
96 push direction
98 housing element
100 releasing step
102 blocking element
104 blocking nose
106 bar
108 bar
110 recess
112 notch
114 relief element

The invention claimed is:

1. Fixing unit for reversibly fixing a moveable unit, wherein the fixing unit is moveable parallel to a move direction of the moveable unit into a release position in order to release the moveable unit from a guiding rail, wherein the fixing unit comprises a latch, which is arrangeable in a recess of the guiding rail for fixing the moveable unit to the guiding rail, wherein the fixing unit comprises at least one flexible arm connected to the latch and to a body element of the fixing unit, wherein the fixing unit comprises at least one further flexible arm connected to the latch and the body element, wherein the further flexible arm is arranged relative to the flexible arm on an opposite side of the latch, wherein the flexible arm and the further flexible arm each extend at least substantially parallel to a move direction, wherein the latch is only held by means of the flexible arm and the further flexible arm.

2. The fixing unit according to claim 1, wherein the flexible arm and the further flexible arm are integrally formed with the latch as a one-piece embodiment.

3. The fixing unit according to claim 1, wherein the fixing unit is bar-shaped.

4. The fixing unit according to claim 1, wherein a total width extension of the fixing unit is maximum 10 mm.

5. The fixing unit according to claim 1, comprising at least one operating element, which can be pulled or pushed parallel to the move direction to release the moveable unit from the guiding rail.

6. The fixing unit according to claim 5, wherein the operating element can only be pulled parallel to the move direction to release the moveable unit in a pull direction, wherein if the moveable unit is in a storage position and the operating element is pushed parallel to the move direction, the operating element is intended to block a movement of the moveable unit in a push direction.

7. The fixing unit according to claim 1, wherein the fixing unit is symmetrical with respect to a symmetry plane, which is perpendicular to the move direction.

8. The fixing unit according to claim 1, comprising a resetting unit for transferring the fixing unit from the release position into a rest position.

9. The fixing unit according to claim 8, wherein the resetting unit comprises at least one spring element, which is implemented for transferring the fixing unit from the release position into the rest position.

10. The fixing unit according to claim 9, wherein the spring element is configured to reset the parallel movement of the fixing unit relative to the moveable unit from the release position to the rest position.

11. The fixing unit according to claim 1, wherein the flexible arm is deformed when the fixing unit is in the release position.

12. A moveable assembly comprising at least one fixing unit according to claim 1 and a moveable unit.

13. The moveable assembly according to claim 12, wherein an extension of the fixing unit is greater than an extension of the moveable unit when viewed in depth direction.

14. A base unit comprising at least one moveable assembly according to claim 12 and the guiding rail.

15. The base unit according to claim 14, wherein the guiding rail is configured for receiving at least the moveable assembly, wherein the moveable assembly received in the guiding rail is moveable parallel to an insertion direction of the moveable assembly along at least the guiding rail with respect to the guiding rail, wherein in a storage position the moveable assembly is fixed and/or locked by the fixing unit in at least the guiding rail.

16. The fixing unit according to claim 1, wherein the latch is tiltable at least essentially around a tilt axis, which, as a normal of the latch, passes at least substantially through the connection point of the flexible arm and the latch.

17. The fixing unit according to claim 1, comprising at least one further flexible arm connected to the latch and to the body element of the fixing unit, wherein the further flexible arm is arranged relative to the flexible arm on an opposite side of the latch.

18. A method for releasing a moveable assembly from a guiding rail of a base unit wherein a fixing unit is moved parallel to a move direction of a moveable unit into a release position in order to release the moveable unit from a guiding rail of the base unit, wherein the fixing unit comprises a latch, which is arrangeable in a recess of the guiding rail for fixing the moveable unit to the guiding rail, wherein the fixing unit comprises at least one flexible arm connected to the latch and to a body element of the fixing unit, wherein the recess is a notch formed in a guiding surface of the guiding rail, shaped to accommodate the latch in a form-locking manner, thereby securing the moveable assembly against displacement along the guiding rail.

19. Fixing unit for reversibly fixing a moveable unit, wherein the fixing unit is moveable parallel relative to the moveable unit to a move direction of the moveable unit into a release position in order to release the moveable unit from a guiding rail, wherein the fixing unit comprises a latch, which is arrangeable in a recess of the guiding rail for fixing the moveable unit to the guiding rail, wherein a body element is moveable parallel relative to the moveable unit, wherein a flexible arm is compressible due to a push or pull of a operating element, leading to the latch being lifted out of the recess.

* * * * *